United States Patent [19]

Musgrave

[11] 3,941,164

[45] Mar. 2, 1976

[54] PROCESS FOR MAKING BARBED MATERIAL

[76] Inventor: Daniel D. Musgrave, 8201 Caraway St., Cabin John, Md. 20731

[22] Filed: Feb. 13, 1975

[21] Appl. No.: 549,680

[52] U.S. Cl. ..... 140/58; 29/7.1
[51] Int. Cl.[2] ..... B21F 25/00
[58] Field of Search ..... 140/58, 66; 72/56; 29/7.1

[56] References Cited

UNITED STATES PATENTS

| | | | |
|---|---|---|---|
| 2,948,049 | 8/1960 | Wilson | 140/58 |
| 3,203,211 | 8/1965 | Mallinckrodt | 72/56 |
| 3,423,978 | 1/1969 | Kline | 72/56 |
| 3,763,529 | 10/1973 | Musgrave | 140/58 |

*Primary Examiner*—Lowell A. Larson

[57] ABSTRACT

A process for making barbed material without scrap loss. The first step in manufacture is slitting the edge of the material to form points. The points are then bent to an exposed position by tractive magnetic means. As an additional step the pointed portions can be further displaced away from the edge by elongating or twisting the material.

12 Claims, 8 Drawing Figures

PROCESS FOR MAKING BARBED MATERIAL

This invention relates to barbed tape for use in barricades and entanglements for obstacle purposes. Such tapes are convenient to transport as they can be coiled on a reel, the sides of which can cover the barbs. When installed in the obstacle, the tape may be twisted longitudinally to orient the barbs in various directions. Another form of tape obstacle is the concertina, a self-supporting spiral with a diameter of about one meter, which rests directly on the ground. Various other way of using barbed tape are well-known and need not be described here. An example is the General Purpose Barbed Tape Obstacle, now used in the United States Army, which is disclosed in U.S. Pat. No. 3,463,455.

For military operations large quantities of obstacle material are required. Economical production of barbed tape is therefore necessary if it is to compete with other obstacle materials. However it is not intended to imply that barbed tape is limited to military use, although that is its principal employment.

In consideration of the foregoing, the principal object of this invention is to provide a simple process for making barbed material, which might be tape or strip or other forms.

Another object is to provide a process for making barbed material with a minimum of labor and machinery, and with minimum scrap loss.

These and other objects and advantages of the present invention will become apparent upon consideration of the following detailed description taken in conjunction with the accompanying drawings in which.

The forms of barb shown are merely used as examples to disclose the process, and they should not be considered limiting. Most barbed tape in use at the present time is made of steel. The process disclosed herein can be used to form barbs on steel, or on various other ferromagnetic materials. In general, the material employed for barbed tape must be hard, deformable, and flexible.

Figure 1:
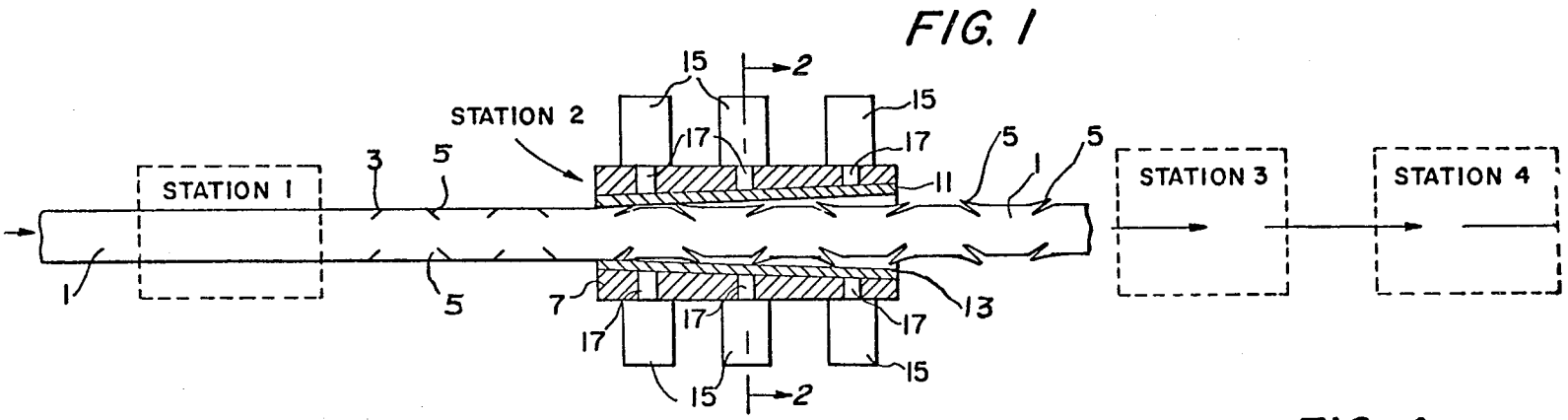
FIG. 1 is a plan view, partly schematic, of a strip of tape undergoing the process of being made into barbed tape.

Referring now to the drawings in detail, FIG. 1 shows a ferromagnetic tape 1 undergoing a process for making barbs thereon. The tape is assumed to be moving from left to right across the page, with steps in the process taking place at four locations marked station 1, station 2, station 3, and station 4.

At station 1, slits 3 are formed intersecting each edge of the tape at an acute angle to form points 5. The machinery used at station 1 need not be described here as devices to accomplish this are well-known in the art.

At station 2 is located a magnetic barb former comprising a housing 7 through which passes a longitudinal channel 9. The housing can be made of any suitable material, preferably not ferromagnetic.

The diverging sides of the channel along which the slit edges of tape 1 slide are lined with smooth pieces 11 and 13, of any suitable material, preferably ferromagnetic. Extending from housing 7 are a plurality of electromagnets 15 each having a pole such as 17 in contact with one of the smooth liner pieces 11 or 13. Means (not shown) are provided to energize the electromagnets, with predetermined polarity, when desired.

As the tape moves through the channel, the electromagnets being energized, points 5 are in sliding contact with liner pieces 11 and 13 which diverge somewhat and by magnetic traction, bend the points out from the tape. Of course, this requires that the polarity of the poles contacting the liner pieces should be so determined as to exert the desired traction on the points.

Furthermore, it is necessary to keep the tape moving substantially in the center of channel 9. In FIG. 1 this is assumed to be accomplished by maintaining significant longitudinal tension on tape 1 as it passes through the channel. Various other methods of doing this can be suggested. For example, a pair of rollers could be mounted in housing 7 and the tape could pass between them under sufficient compression to assure that it cannot deviate from the centerline. The rollers can be either driven or idle. Such devices are well known in the sheet metal art.

If the tape is not kept centered, it might tend to be drawn closer to one or the other of pieces 11 or 13, thus leaving a gap which would prevent the tractive magnetic action of the other piece. It is apparent therefore that whatever type of machinery which may be employed must move the material to be barbed in a definite and correct relationship with the tractive magnetic means.

Figure 8:
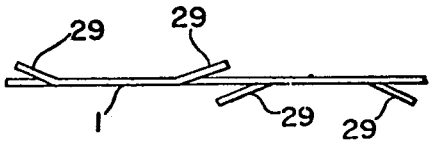
FIG. 8 shows an edge-view of tape having barbs bent out of the flat plane of the tape.

It should be pointed out that the magnetic means can be so arranged as to bend the barbs in the vertical plane as well as laterally, as illustrated in FIG. 1. One type of barb which might be thus produced is shown at 29 in FIG. 8. Obviously, arrangements can be devised for bending in both planes, either simultaneously, or sequentially, to produce a variety of barb forms, not illustrated. For convenience, the plane of the surface of the tape shown in FIGS. 1 and 4 will be referred to as the major flat plane of the tape.

Figure 2:
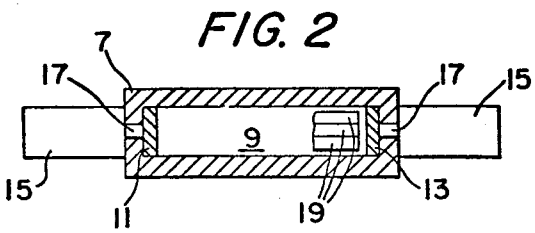
FIG. 2 is a cross section, taken on FIG. 1, in the plane indicated by the numerals 2-2.

The process can be performed simultaneously on several tapes, superimposed as indicated at 19 in FIG. 2.

Although the tape leaves station 2 with barbs formed it may be desired to perform further steps. For example, at station 3, holes may be punched in the tape, such as those shown at 21 in FIG. 4. The holes make the tape easier to deform, as will be explained below.

Figure 4:
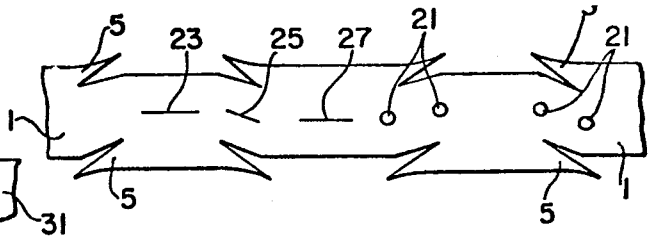
FIG. 4 is a view of a portion of tape having a different form of barb.

Furthermore, it may be desired to elongate the tape by conventional machinery, at station 4. The elongation is accomplished in such a way as to move the barbs away from the center line of the tape to a position whereat they are more effective for obstacle purposes. FIG. 4 shows a portion of a tape which has passed through stations 1, 2, 3, and 4.

At station 1 the edges were slit. At station 2 the barbs were bent by magnetic traction. At station 3 holes 21 were punched. At station 4 the tape was subjected to an elongating force by conventional machinery which need not be described here. Such a force will tend to align the centers 23, 25, and 27 of the several offset, contiguous portions of the tape. The result will be to move each barbed portion away from the original center line of the tape, which condition is shown in FIG. 4.

The process of displacing portions of a tape laterally by slitting and elongating is disclosed in detail in U.S. Pat. No. 3,763,529.

Figure 3:
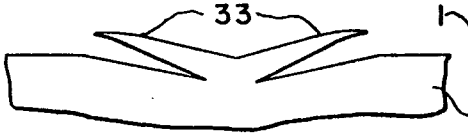
FIG. 3 is a view of one type of barb.

FIG. 3 shows a portion of barbed material 31 having long, slender barbs 33 formed thereon. It is readily apparent that such barbs can be formed by tractive magnetic means.

Figure 6:
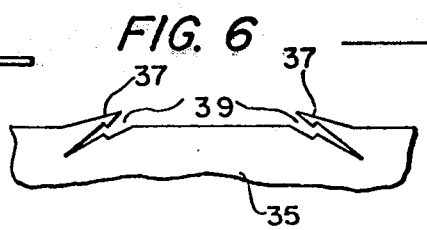
FIG. 6 shows another form of barb.

FIG. 6 shows a portion of barbed material 35 having hooked barbs 37 formed thereon. The hooked barbs can be formed by slitting the edge of the material with a notched or offset slit as indicated at 39 in FIG. 6 and then bending the barbed portion by tractive magnetic means.

Figure 5:
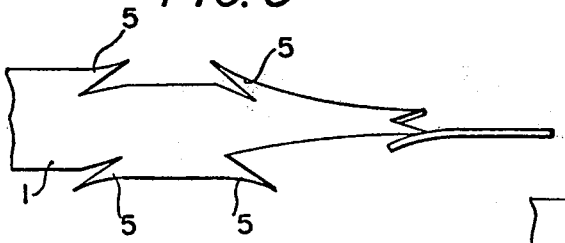
FIG. 5 shows the same portion of tape as FIG. 4, but twisted longitudinally.

FIG. 5 shows how tape may be twisted when installed in an obstacle. It will be noted that the twisting tends to expose barbs 5 more than when the tape is flat.

Figure 7:
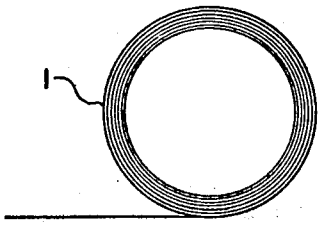
FIG. 7 shows tape coiled into a roll.

FIG. 7 shows how tape can be coiled into a roll for storage or transportation. There is a relation between the length of the barbs and the minimum diameter to which the tape can be rolled. Generally, a longer barb requires a greater diameter.

Barbed material made by the method described hereinbefore may be subjected to further well-known processes to modify physical properties, add protective coating, or otherwise improve the product. It should be understood that the sequence of the various steps in production may be varied to suit circumstances. It should also be pointed out that this process can be used with suitable machinery, to produce barbed tape preformed in helical coils with the flat plane of the tape substantially perpendicular to the axis of the helix.

What I claim is:

1. A process for making barbed material comprising: forming a slit intersecting an edge of a flat piece of magnetic material at an acute angle with said edge; and bending a portion defined by said slit and said edge out from said material by tractive magnetic means.

2. A process for making barbed tape comprising: forming a plurality of slits intersecting two edges of a strip of deformable flexible magnetic material at an acute angle with but not extending to the centerline of said strip; and bending portions defined by said slits and said edges out from said strip by tractive magnetic means.

3. A process as set forth in claim 2 further characterized by the recited steps being performed simultaneously on more than one strip.

4. A process as set forth in claim 2 further characterized by a step for elongating said strip along its longitudinal axis.

5. A process as set forth in claim 2 further characterized by a step for twisting said strip around its longitudinal axis.

6. A process as set forth in claim 2 further characterized by a step for coiling said strip into a coil.

7. A process as set forth in claim 2 further characterized by a step for forming holes in said strip.

8. A process as set forth in claim 2 further characterized by a step for hardening said strip.

9. A process as set forth in claim 2 further characterized by each of said slits having an offset section which defines a hook on said portions defined by said slits and said edges.

10. A process as set forth in claim 2 further characterized by said bending of said portions being accomplished substantially parallel to the major flat plane of said strip.

11. A process as set forth in claim 2 further characterized by said bending of said portions being accomplished substantially at an angle to the major flat plane of said strip.

12. A process as set forth in claim 2 further characterized by said bending of said portions being accomplished while said strip is moving relative to said tractive magnetic means.

* * * * *